US010297242B2

(12) United States Patent
Kwak

(10) Patent No.: US 10,297,242 B2
(45) Date of Patent: May 21, 2019

(54) UKULELE

(71) Applicant: Grantec (Xiamen) Co., Ltd., Xiamen, Fujian (CN)

(72) Inventor: Bong Yol Kwak, Xiamen (CN)

(73) Assignee: GRANTEC (XIAMEN) CO., LTD., Xiamen, Fujian (CN)

( * ) Notice: Subject to any disclaimer, the term of this patent is extended or adjusted under 35 U.S.C. 154(b) by 3 days.

(21) Appl. No.: 15/818,708

(22) Filed: Nov. 20, 2017

(65) Prior Publication Data

US 2019/0051279 A1 Feb. 14, 2019

(30) Foreign Application Priority Data

Aug. 10, 2017 (CN) ..... 2017 2 0998847 U

(51) Int. Cl.

| | |
|---|---|
| ***G10H 3/18*** | (2006.01) |
| ***G10H 1/02*** | (2006.01) |
| ***G10H 1/46*** | (2006.01) |
| ***G10D 1/08*** | (2006.01) |

(52) U.S. Cl.

CPC ..... *G10H 3/18* (2013.01); *G10D 1/08* (2013.01); *G10H 1/02* (2013.01); *G10H 1/46* (2013.01)

(58) Field of Classification Search

CPC .. G10H 3/18; G10H 1/02; G10H 1/46; G10D 1/08

USPC ..... 84/731

See application file for complete search history.

(56) References Cited

U.S. PATENT DOCUMENTS

| | | | | |
|---|---|---|---|---|
| 3,743,751 | A * | 7/1973 | Ibanez | G10H 1/40 84/741 |
| D510,946 | S * | 10/2005 | Kitazawa | D17/14 |
| 7,241,948 | B2 * | 7/2007 | Cummings | G10H 3/188 84/723 |
| 7,385,125 | B2 * | 6/2008 | Motsenbocker | G10H 3/185 84/10 |
| 7,589,274 | B2 * | 9/2009 | Funaki | G10H 1/0058 84/645 |
| 7,812,243 | B2 * | 10/2010 | Celi | G10H 1/053 84/723 |
| 9,196,235 | B2 * | 11/2015 | Ball | G10H 1/18 |
| 9,640,162 | B2 * | 5/2017 | Ball | G10H 1/18 |
| 9,761,211 | B2 * | 9/2017 | Redding | G10H 3/18 |
| 9,773,487 | B2 * | 9/2017 | Alt | G10H 3/181 |
| 9,786,260 | B2 * | 10/2017 | Fishman | G10H 3/186 |
| 2004/0187673 | A1 * | 9/2004 | Stevenson | G10H 1/02 84/737 |
| 2014/0150630 | A1 * | 6/2014 | Juszkiewicz | G10H 1/44 84/626 |
| 2015/0013526 | A1 * | 1/2015 | Packouz | G10H 3/186 84/603 |
| 2015/0294656 | A1 * | 10/2015 | Hanuschak | G06F 3/167 84/453 |

(Continued)

*Primary Examiner* — Jeffrey Donels

(74) *Attorney, Agent, or Firm* — Leong C. Lei

(57) ABSTRACT

A ukulele includes a ukulele main body and a circuit board. The ukulele main body includes a head, strings, a fret board, and a body. A front surface of the body is provided with a saddle and a bridge. The circuit board is disposed in the body. The circuit board includes a power supply module, a Bluetooth audio input module, a pickup module, a mixing module, and an audio output module. The ukulele can be played in conjunction with a smart phone accompaniment and ensure the timbre of playing.

6 Claims, 5 Drawing Sheets

(56) References Cited

U.S. PATENT DOCUMENTS

| | | | | |
|---|---|---|---|---|
| 2016/0148609 | A1* | 5/2016 | Beck | G10H 1/342<br>84/731 |
| 2017/0358287 | A1* | 12/2017 | Redding | G10H 3/186 |

* cited by examiner

UKULELE

BACKGROUND OF THE INVENTION

1. Field of the Invention

The present invention relates to an instrument, and more particularly to a ukulele.

2. Description of the Prior Art

A ukulele is a four-string Hawaiian lute instrument. The ukulele was introduced to Hawaii by Portuguese immigrants, which is a small guitar-like instrument.

Ukulele generally comprises a head, strings, a fret board, and a body. The head is mounted at the upper end of the fret board. The body is mounted at the lower end of the fret board. The head is provided with four fixing knobs for fixing the strings. The side of the head is provided with tuners connected with the fixing buttons respectively. The junction of the head and the fret board is provided with a nut. The fret board is provided with frets to divide the fret board into a plurality of sections. The front surface of the body is provided with a saddle and a bridge. The upper ends of the strings are fixed to the fixing buttons, respectively. The lower ends of the strings are fixed on the saddle across the bridge.

A ukulele is smaller in size than a general guitar, suitable for playing simple and cheerful music, so it is a very popular instrument. The ukulele sounds through the resonance box and the sound is small and has less timbre change, so it is played simply. These days, people like to play the ukulele with a smart phone accompaniment. The smart phone accompaniment and the sound of the ukulele are directly mixed in the air and transmitted to the human ears. Because the amplifier of the smart phone is small, the smart phone accompaniment and the sound of the ukulele cannot be perfectly mixed together, resulting in poor timbre of the performance.

SUMMARY OF THE INVENTION

The primary object of the present invention is to provide a ukulele that can be played in conjunction with a smart phone accompaniment and ensure the timbre of playing.

In order to achieve the aforesaid object, the ukulele of the present invention comprises a ukulele main body. The ukulele main body comprises a head, strings, a fret board and a body. A front surface of the body is provided with a saddle and a bridge. The ukulele further comprises a circuit board. The circuit board is disposed in the body. The circuit board is provided with a power supply module, a Bluetooth audio input module, a pickup module, a mixing module, and an audio output module. The power supply module supplies power to the Bluetooth audio input module, the mixing module, and the audio output module. The Bluetooth audio input module and the pickup module are connected with two input ends of the mixing module, respectively. An output end of the mixing module is connected with the audio output module. The pickup module includes a piezoelectric pickup. The piezoelectric pickup is disposed between the saddle and the bridge. The audio output module includes an earphone socket and an audio socket. An amplifying circuit is provided between the earphone socket and the mixing module. The earphone socket and the audio socket are disposed on one side of the body.

Preferably, the circuit board is provided with a charging module. The charging module is connected with the power supply module. The power supply module includes a lithium battery. The charging module includes a charging interface. The charging interface is disposed on the side of the body.

Preferably, the charging interface is a Micro USB interface.

Preferably, a tone adjustment potentiometer and a volume adjustment potentiometer are connected between the pickup module and the mixing module.

Preferably, the tone adjustment potentiometer and the volume adjustment potentiometer are provided with knobs, respectively. The knobs are disposed on the front surface of the body.

Preferably, a Bluetooth power switch is provided between the power supply module and the Bluetooth audio input module.

Preferably, the body is provided with a resonance box.

Preferably, the body is a solid structure.

According to the above-described technical solution, the present invention has the following effects.

When the present invention is in use, the first audio signal of the smart phone accompaniment is input to the mixing module through the Bluetooth audio input module. The user can play the ukulele body according to the accompaniment. The second audio signal generated by playing the ukulele body is transmitted to the mixing module through the pickup module. The first audio signal and the second audio signal are mixed by the mixing module to form a third audio signal. The third audio signal is outputted through the audio output module. Thus, the ukulele of the present invention can be played in conjunction with the smart phone accompaniment. The first audio signal of the accompaniment and the second audio signal of the playing are mixed by the mixing module. The mixing of the first audio signal and the second audio signal won't be affected by the external environment so as to ensure the quality of the third audio signal and thus to ensure the performance of the playing. The piezoelectric pickup of the pickup module of the present invention can collect the second audio signal played by the user and reduce the noise collected by the pickup module to ensure that the audio signal collected by the pickup module is the sound played from the ukulele body as much as possible.

DETAILED DESCRIPTION OF THE PREFERRED EMBODIMENTS

Figure 1:
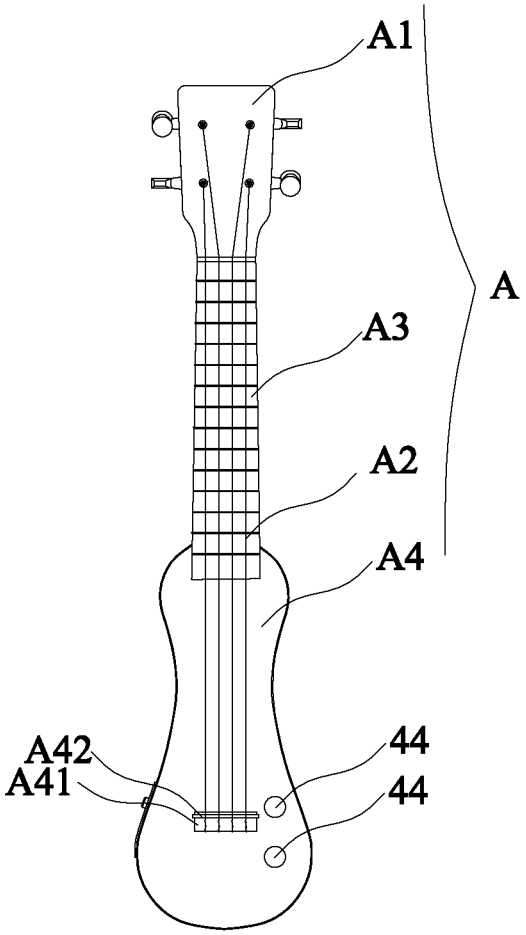
FIG. 1 is a first schematic view of the present invention.
Figure 2:
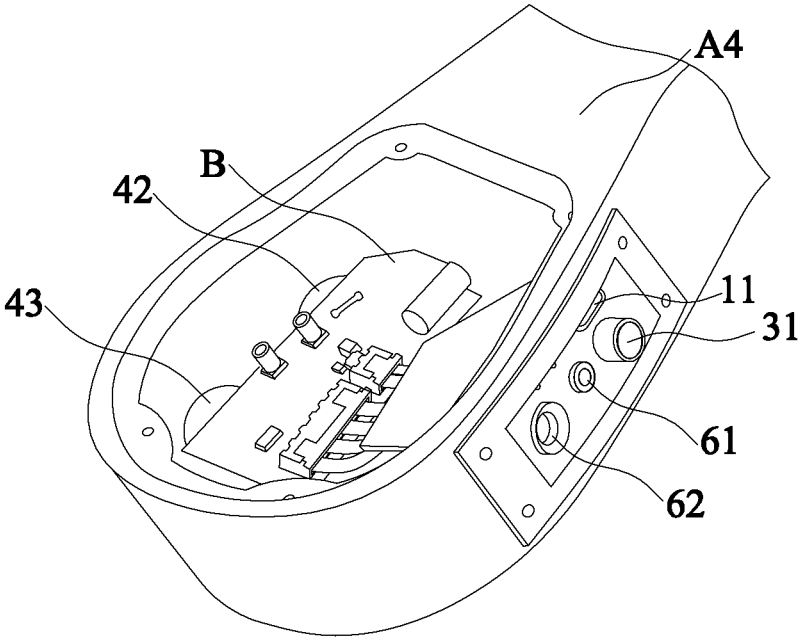
FIG. 2 is a second schematic view of the present invention.

Embodiments of the present invention will now be described, by way of example only, with reference to the accompanying drawings.

Referring to FIG. 1 to FIG. 5, the present invention discloses a ukulele. The ukulele comprises a ukulele main body A and a circuit board B. The ukulele main body A comprises a head A1, strings A2, a fret board A3, and a body A4. The body A4 is provided with a saddle A41 and a bridge A42. The circuit board B is disposed in the body A4. The circuit board B is provided with a charging module 1, a power supply module 2, a Bluetooth audio input module 3, a pickup module 4, a mixing module 5, and an audio output module 6.

Figure 4:
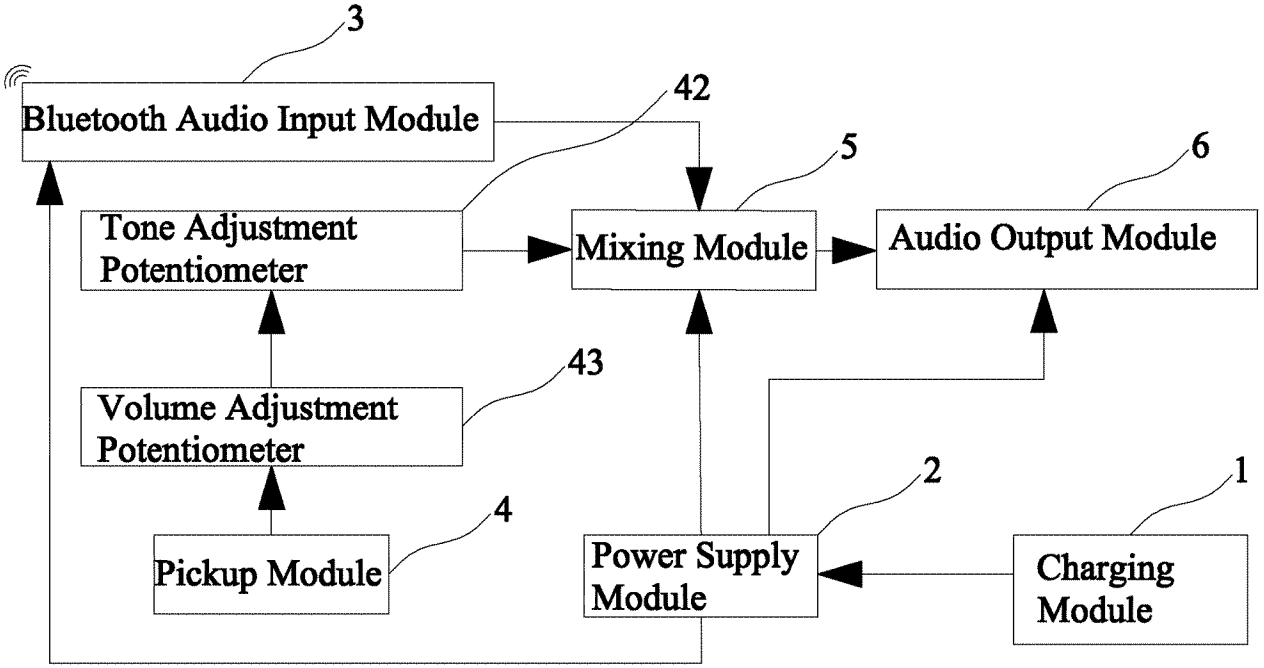
FIG. 4 is a block diagram of circuit board of the present invention.

As shown in FIG. 4, the charging module 1 is connected with the power supply module 2. The power supply module 2 supplies power to the Bluetooth audio input module 3, the pickup module 4, the mixing module 5, and the audio output module 6. The Bluetooth audio input module 3 and the pickup module 4 are connected with two input ends of the mixing module 5, respectively. An output end of the mixing module 5 is connected with the audio output module 6.

Figure 5:
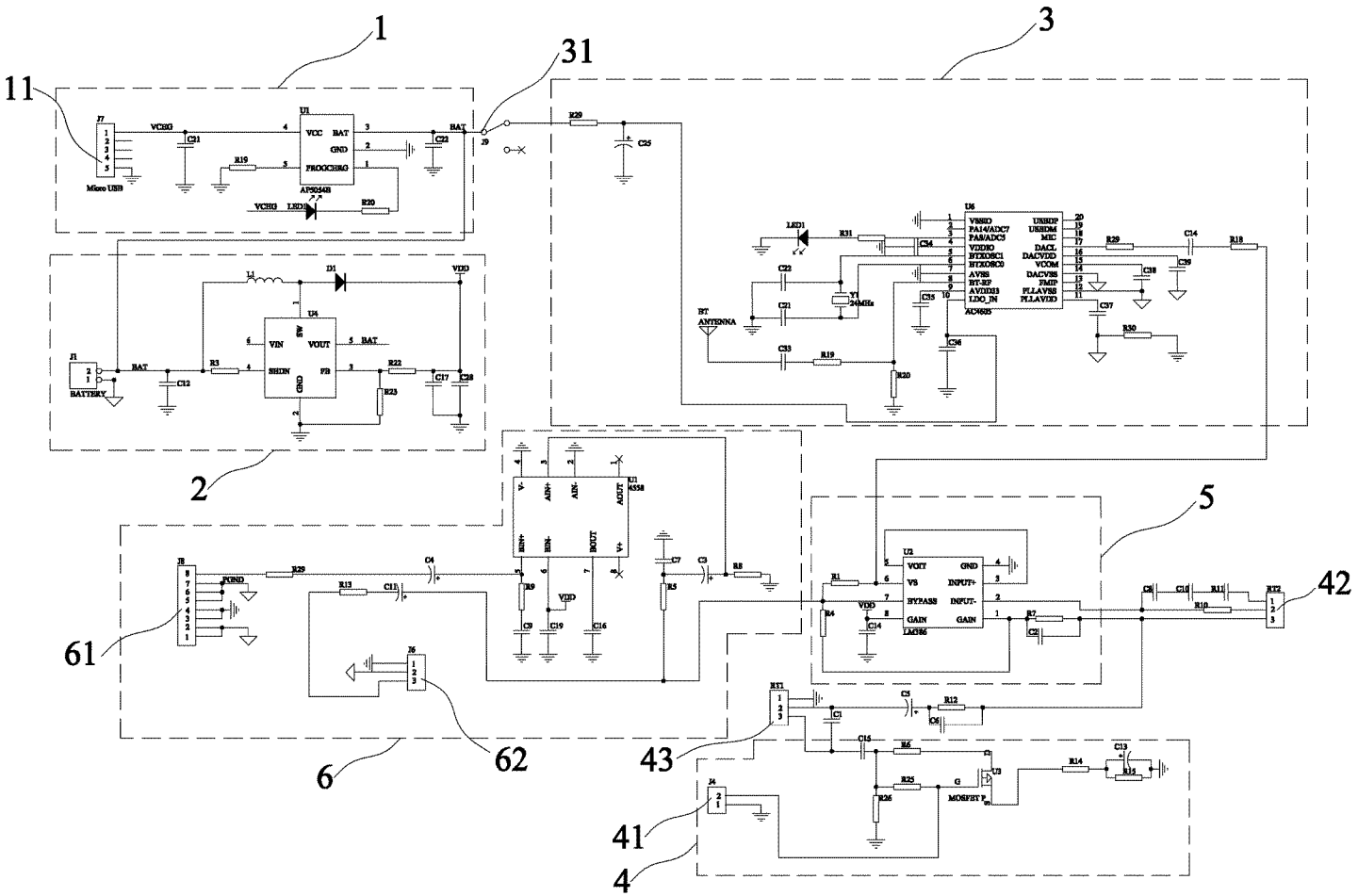
FIG. 5 is a schematic view of the circuit board of the present invention.

As shown in FIG. 5, the power supply module 2 includes a lithium battery, a power management chip, and a peripheral circuit of the power management chip. The specific model of the power management chip is AP2000.

The charging module 1 includes a charging interface 11, a charging management chip, and a peripheral circuit of the charging management chip. The model of the charging management chip is AP5054B. The charging interface 11 is disposed on one side of the body A4. Preferably, the charging interface 11 is a Micro USB interface for use with a conventional power cord for a smart phone of an existing Android system, facilitating charging.

The Bluetooth audio input module 3 comprises a Bluetooth chip and a peripheral circuit of the Bluetooth chip. The specific model of the Bluetooth chip is AC4605. The Bluetooth audio input module is connected with the smart phone, and receives the first audio signal of the smart phone accompaniment, and transmits the first audio signal to the mixing module 5. Further, in order to reduce the power consumption, a Bluetooth power switch 31 is provided between the power supply module 2 and the Bluetooth audio input module 3. The operation of the Bluetooth audio input module 3 can be realized by turning on and off the Bluetooth power switch 31, thereby reducing the power consumption.

Figure 3:
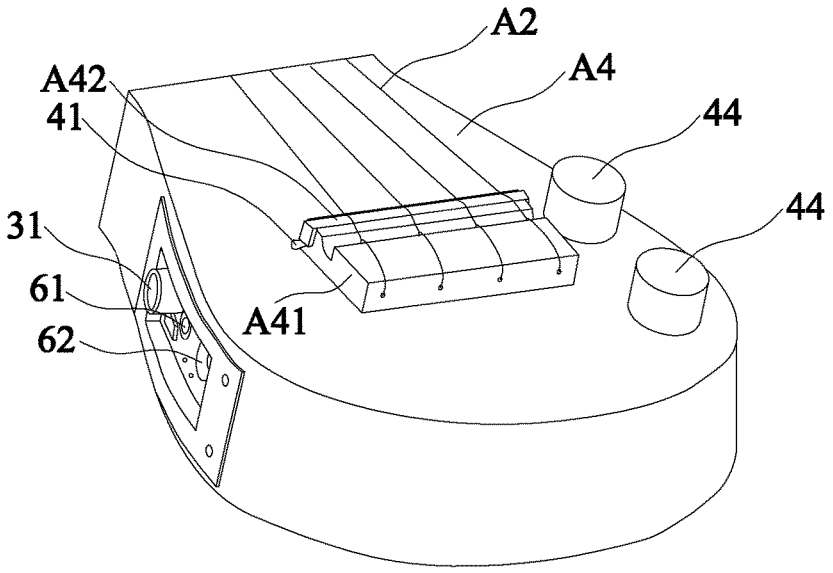
FIG. 3 is a third schematic view of the present invention.

The pickup module 4 includes a piezoelectric pickup 41 and a filtering and amplifying circuit. Referring to FIG. 3, the piezoelectric pickup 41 is disposed between the saddle A41 and the bridge A42. When the user plays the ukulele body A, the vibrations of the strings A2 are transmitted to the saddle A41 and the bridge A42. The piezoelectric pickup 41 of the pickup module 4 can collect the second audio signal played by the user and reduce the noise collected by the pickup module 4 to ensure that the audio signal collected by the pickup module 4 is the sound played from the ukulele body A as much as possible. Further, a tone adjustment potentiometer 42 and a volume adjustment potentiometer 43 are connected between the pickup module 4 and the mixing module 5. The tone adjustment potentiometer 42 and the volume adjustment potentiometer 43 can adjust the tone and the volume of the second audio signal collected by the pickup module 4. For the user to adjust the tone and the volume conveniently, the tone adjustment potentiometer 42 and the volume adjustment potentiometer 43 are provided with knobs 44, respectively. The knobs 44 are disposed on the front surface of the body 4.

The mixing module 5 comprises an audio amplifying circuit. The audio amplifying circuit uses a power amplifier LM386 and its supporting devices. The first audio signal transmitted by the Bluetooth audio input module 3 and the second audio signal collected by the pickup module 4 can be mixed by the mixing module 5 to form a third audio signal.

The audio output module 6 includes an earphone socket 61 and an audio socket 62. The user may use an earphone cable or an audio cable to connect an earphone or an external loudspeaker for converting the third audio signal output from the mixing module 5 into sound for playing. The audio output module 6 uses the earphone socket 61 and the audio socket 62 to transmit the third audio signal completely to the earphone or the external loudspeaker, thereby avoiding loss of the third audio signal and ensuring the timbre of the sound played by the earphone or the external loudspeaker. In order to prevent the earphone cable and the audio cable from affecting the user's performance, the earphone socket 61 and the audio socket 62 are disposed on the side of the body A4. In order to ensure the timbre of the sound played by the earphone, an amplifying circuit is provided between the earphone socket 61 and the mixing module 5. The amplifier of the amplifying circuit is JRC4558.

When the present invention is in used, the user may connect the earphone and/or the external loudspeaker with the audio output module 6 for outputting the sound. Specifically, the user uses the external loudspeaker, as an example, to illustrate the use of the present invention. When in use, the Bluetooth of the smart phone is connected with the Bluetooth audio input module 3 of the present invention, and then the first audio signal of the smart phone accompaniment is input to the mixing module 5 through the Bluetooth audio input module 3. The user can play the ukulele body A according to the accompaniment. The playing of the ukulele leads to the vibration of the bridge A42 and the saddle A41. The second audio signal generated by playing the ukulele body A is transmitted to the mixing module 5 through the pickup module 4. The first audio signal and the second audio signal are mixed by the mixing module 5 to form a third audio signal to be outputted to the audio output module 6, and the third audio signal is outputted through the audio output module 6 to the external loudspeaker. The user can adjust the tone and the volume of the second audio signal through the tone adjustment potentiometer 42 and the volume adjustment potentiometer 43. The volume of the first audio signal can be adjusted by the smart phone.

Furthermore, the body A4 is provided with a resonance box, so that the user can play the ukulele in the same manner as the conventional ukulele and the sound is outputted through the resonance box. The body A4 may be a solid structure, that is, there is no resonant box on the body A4, such that when in use, the user can hear the sound through the earphone and the sound is confined in the earphone to avoid disturbing the neighbors.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A ukulele, comprising a ukulele main body, the ukulele main body comprising a head, strings, a fret board and a body, a front surface of the body being provided with a saddle and a bridge;

wherein the ukulele further comprises a circuit board, the circuit board being disposed in the body; the circuit board being provided with a power supply module, a Bluetooth audio input module, a pickup module, a mixing module, and an audio output module;

the power supply module supplying power to the Bluetooth audio input module, the mixing module and the audio output module, the Bluetooth audio input module and the pickup module being connected with two input ends of the mixing module respectively, an output end of the mixing module being connected with the audio output module; the pickup module including a piezoelectric pickup, the piezoelectric pickup being disposed between the saddle and the bridge that are spaced from each other to collect an audio signal generated by the strings; the audio output module including an earphone socket and an audio socket, an amplifying circuit being provided between the earphone socket and the mixing module, the earphone socket and the audio socket being disposed on one side of the body;

a tone adjustment potentiometer and a volume adjustment potentiometer being connected between the pickup module and the mixing module, the tone adjustment potentiometer and the volume adjustment potentiometer being respectively provided with knobs that are disposed on the front surface of the body;

the piezoelectric pickup of the pickup module that is disposed between the saddle and the bridge collecting an audio signal generated by the strings, the Bluetooth audio input module adapted to receive an external audio signal, wherein the Bluetooth audio input module that receives an external audio signal supplies a first audio signal corresponding to the external audio signal to the mixing module and the pickup module that collects the audio signal generated by the strings generates a second audio signal corresponding to the audio signal generated by the strings to the mixing module, so that the mixing module to which the pickup module and the Bluetooth audio input module are connected mixes the second audio signal that corresponds to the audio signal generated by the strings with the first audio signal that corresponds to the external audio signal received through the Bluetooth audio input module to form a third audio signal that is outputted through the audio output module.

2. The ukulele as claimed in claim 1, wherein the circuit board is provided with a charging module, the charging module is connected with the power supply module; the power supply module includes a lithium battery, the charging module includes a charging interface, and the charging interface is disposed on the side of the body.

3. The ukulele as claimed in claim 2, wherein the charging interface is a Micro USB interface.

4. The ukulele as claimed in claim 1, wherein a Bluetooth power switch is provided between the power supply module and the Bluetooth audio input module.

5. The ukulele as claimed in claim 1, wherein the body is provided with a resonance box.

6. The ukulele as claimed in claim 1, wherein the body is a solid structure.

* * * * *